US005970275A

United States Patent [19]

Brown, Jr. et al.

[11] Patent Number: 5,970,275

[45] Date of Patent: Oct. 19, 1999

[54] DYNAMIC SUPPLY USAGE ESTIMATION

[75] Inventors: Martin Joseph Brown, Jr.; Allen Patrick Johnson; Patricia Ann Valenti, all of Lexington; Earl Dawson Ward, II, Richmond; Timothy Gerard Yorkey, Lexington, all of Ky.

[73] Assignee: Lexmark International, Inc., Lexington, Ky.

[21] Appl. No.: 09/096,890

[22] Filed: Jun. 12, 1998

Related U.S. Application Data

[63] Continuation-in-part of application No. 08/854,606, May 12, 1997, Pat. No. 5,802,420.

[51] Int. Cl.[6] ..... G03G 15/08

[52] U.S. Cl. ..... 399/27; 399/24; 399/25

[58] Field of Search ..... 399/24, 25, 27

[56] References Cited

U.S. PATENT DOCUMENTS

| | | | |
|---|---|---|---|
| 5,160,966 | 11/1992 | Shiina et al. | 399/27 |
| 5,204,699 | 4/1993 | Birnbaum et al. | 347/131 |
| 5,572,292 | 11/1996 | Chatani et al. | 399/25 |
| 5,655,174 | 8/1997 | Hirst | 399/27 |
| 5,724,627 | 3/1998 | Okuno et al. | 399/27 |
| 5,771,420 | 6/1998 | Suzuki et al. | 399/25 |
| 5,794,094 | 8/1998 | Boockholdt et al. | 399/27 |
| 5,802,420 | 9/1998 | Garr et al. | 399/27 |

FOREIGN PATENT DOCUMENTS

| | | |
|---|---|---|
| 5-341611 | 12/1993 | Japan . |
| 6-202472 | 7/1994 | Japan . |
| 9-160364 | 6/1997 | Japan . |

*Primary Examiner*—Matthew S. Smith
*Attorney, Agent, or Firm*—John A. Brady

[57] ABSTRACT

The amount of toner remaining in each toner cartridge (20*a*–20*d*) of a printer (1) is estimated by incrementing a count when one pel is detected in each small region of the bit map. The printer senses toner out, after which the scale ascribed to one count is revised to reflect the actual count to toner out. Specifically, the count to toner out becomes the number representative of empty so that one-half of that count is interpreted as half full. The remaining toner in each cartridge is displayed to the operator at a gauge (21).

6 Claims, 2 Drawing Sheets

DYNAMIC SUPPLY USAGE ESTIMATION

RELATED APPLICATION

This is a continuation-in-part application of U.S. patent application Ser. No. 08/854,606, filed May 12, 1997, now U.S. Pat. No. 5,802,420 entitled "Method and Apparatus for Predicting and Displaying Toner Usage of a Printer".

This invention relates to the field of imaging apparatus, such as printers and copiers, and, more specifically, this invention is directed to determining the amount of marking material, such as toner or ink, remains before the supply of marking material will be exhausted.

BACKGROUND OF THE INVENTION

Displaying the quantity of marking material remaining in a printer or copier is widely achieved in a variety of ways. Typically, the imaging device operates by marking or not marking in grid pattern, each tiny square being termed a pel. It is known to count the number of pels at which ink is printed and the usage of marking material is computed from the number counted. The amount of the beginning or full supply of ink is known and the estimated remaining ink is that amount computed by subtracting the estimated usage. The estimation formulas took into account the size of the dots printed and the characteristics of the imaging device. However, prior to the foregoing parent application, no estimation formula was known which took into account actual usage history of the imaging device.

By taking into account actual usage history, the estimation formula is made more accurate. In accordance with the preferred embodiment of this application, only single sensing for toner/ink-out is employed, which is cost effective. Since the estimation formula is dynamically modified to reflect past usage, the amount of toner or ink remaining during use after resupply of toner or ink is determined with satisfactory accuracy. This is communicated to the operator by some display, which may be a standard gauge-face (alternatively by artificial voice message, panel display after operator inquiry or similar alternatives).

SUMMARY OF THE INVENTION

In an imaging device in which marking material is applied from a supply compartment, the amount of marking material is sensed for exhaustion or near exhaustion of the marking material. Typically, the supply compartment is a separate cartridge which is installed in the imaging device full of marking material and which is removed when empty, followed by a full cartridge being installed. The cartridge may be sensed as near empty by weighing the cartridge or by optical or virtually any other sensing techniques. In a laser cartridge, measuring the physical resistance to movement of a stirrer in the toner is effective and practical. During imaging the bit map of pels to be printed is observed electronically and usage of toner is computed by a formula which ascribes an assumed amount of use based on the presence of bits to be printed. This need not be a rigorous count of the bits. The presence of a bit in a predetermined, small region can be acted on as a "yes" for toner/ink usage in that region. When the sensor signals that toner is out or is near out, the amount calculated is noted and the factors of the estimation formula are adjusted so that the formula would have produced the same result as the sensor. Thus, if the estimation formula shows 1/8 full, the estimation formula is adjusted upward the factor 8/7.

The estimation formula is then used after installation of the next cartridge or other refill. The result from the revised estimation formula is signaled to or may be called out by the printer or copier operator to inform the operator of the status.

BRIEF DESCRIPTION OF THE DRAWINGS

The accompanying drawings incorporated in and forming a part of the specification illustrate several aspects of the present invention, and together with the description and claims serve to explain the principles of the invention. In the drawings:

DETAILED DESCRIPTION OF THE PREFERRED EMBODIMENT

Figure 1:
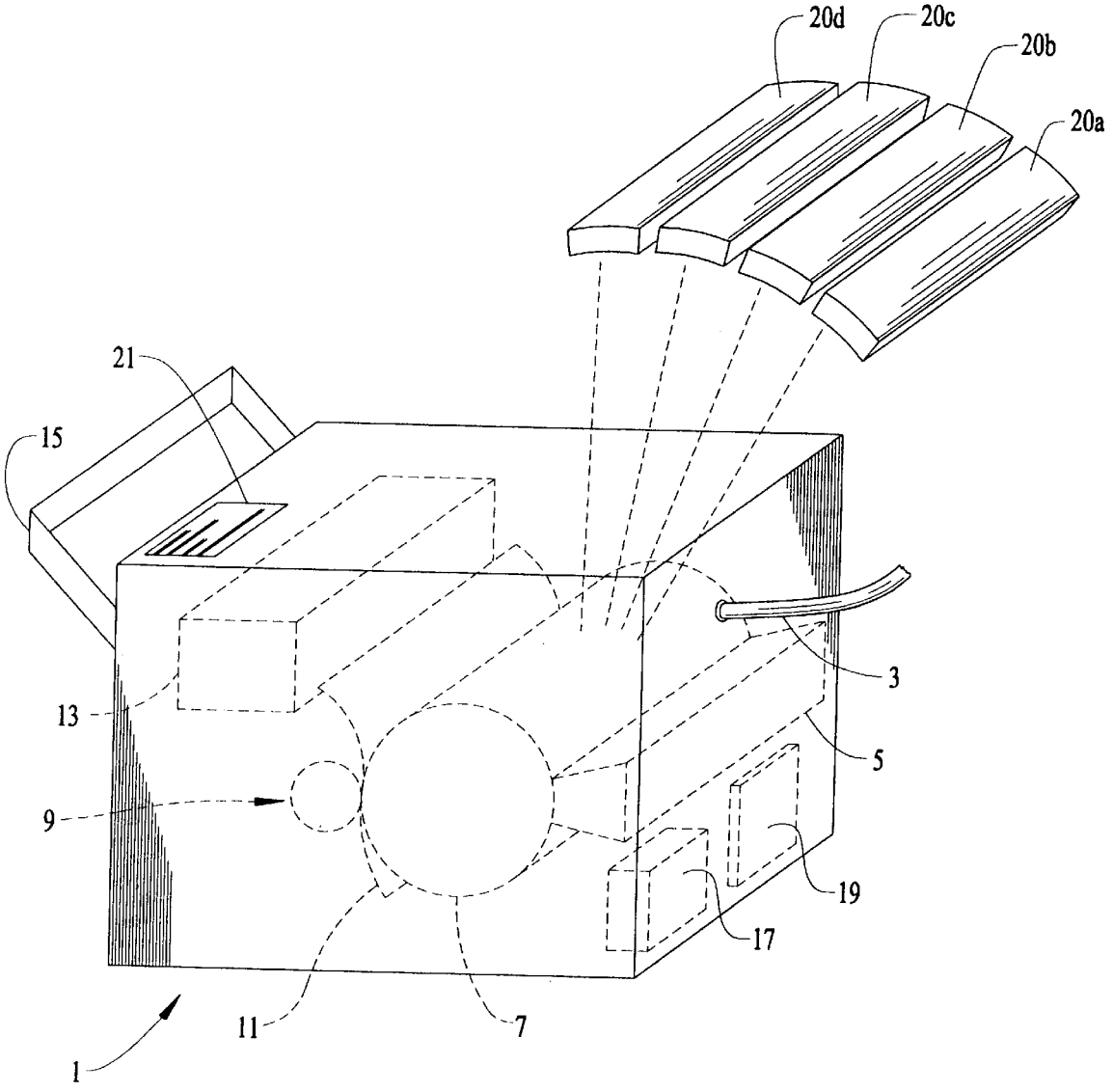
FIG. 1 illustrates generally a printer incorporating this invention.

The preferred embodiment of this invention is implemented in a laser printer, shown illustratively as printer 1. Printer 1 receives control information in a standard manner from communications cable 3. Since the printer 1 may be largely pre-existing, such as the Optra™SC or other Optra™ printer sold in large numbers by the assignee of this invention, most aspects of printer 1 will be described only very generally and aspects not interoperative with this invention may not be mentioned. Although the following description given is primarily to an embodiment in a laser printer using toner, inkjet printers also apply ink to print pels in a bit map so the applicability of this invention to inkjet printers will be evident.

Printer 1 has an optical system 5 operative on drum 7. Drum 7 transfers images defined by optical system 5 at transfer station 9 to paper 11. The image is fixed, typically by heat, at fixing station 13, and the finished printed page is delivered to output tray 15.

Data processor 17 in printer 1 monitors the data received and interprets the data in accordance to the control language or other mode to which the data processor 17 is set. Information received on cable 3, as well as other information, is stored electronically in memory 19. Data processor 17 creates a bit map in a given resolution, in the preferred embodiment, 600×600 dpi (dots per inch resolution). The bit map is stored electronically in memory 19. (Such storing may be by compression, but such memory techniques are irrelevant to this invention.) Each bit in the bit map stored in memory 19 defines a significance (such a white or black) exclusive to one 1/600 inch square in the final image.

This embodiment was developed for use with a multicolor printer. Accordingly, the single imaging mechanism described is illustrative of four separate mechanisms, one in which the toner is black, one for which the toner is magenta, one for which the toner is cyan, and one for which the toner is yellow. This is shown illustratively by four toner-supply cartridges 20*a*, 20*b*, 20*c* and 20*d*, shown spaced from the drum 7 for purposes of illustration. In actual use, cartridge 20*a*–20*d* are adjacent to drum 7 and, in fact, in addition to a compartment for the toner, typically contain their associated drum 7, so that drum 7 and generally other developing mechanisms are replaced with each replacement of a cartridge 20*a*–20*d*.

Also, for purposes of this invention a use gauge 21 of toner is shown on the top of printer 1 where it readily may be observed by an human operator of printer 1. (This positioning is illustrative. In practice such a full showing preferably would be on the monitor of a computer in communication with printer 1.) The display of this gauge might be a continuous bar, each of which is at the top of gauge 21 when a cartridge 20*a*–20*d* is full and each of which shortens to a bottom level in proportion to the estimated use of toner in its respective cartridge 20*a*–20*d*. Of course, virtually any form of communication, including modern introductions such as artificial voice, would be consistent with this invention.

Figure 2:
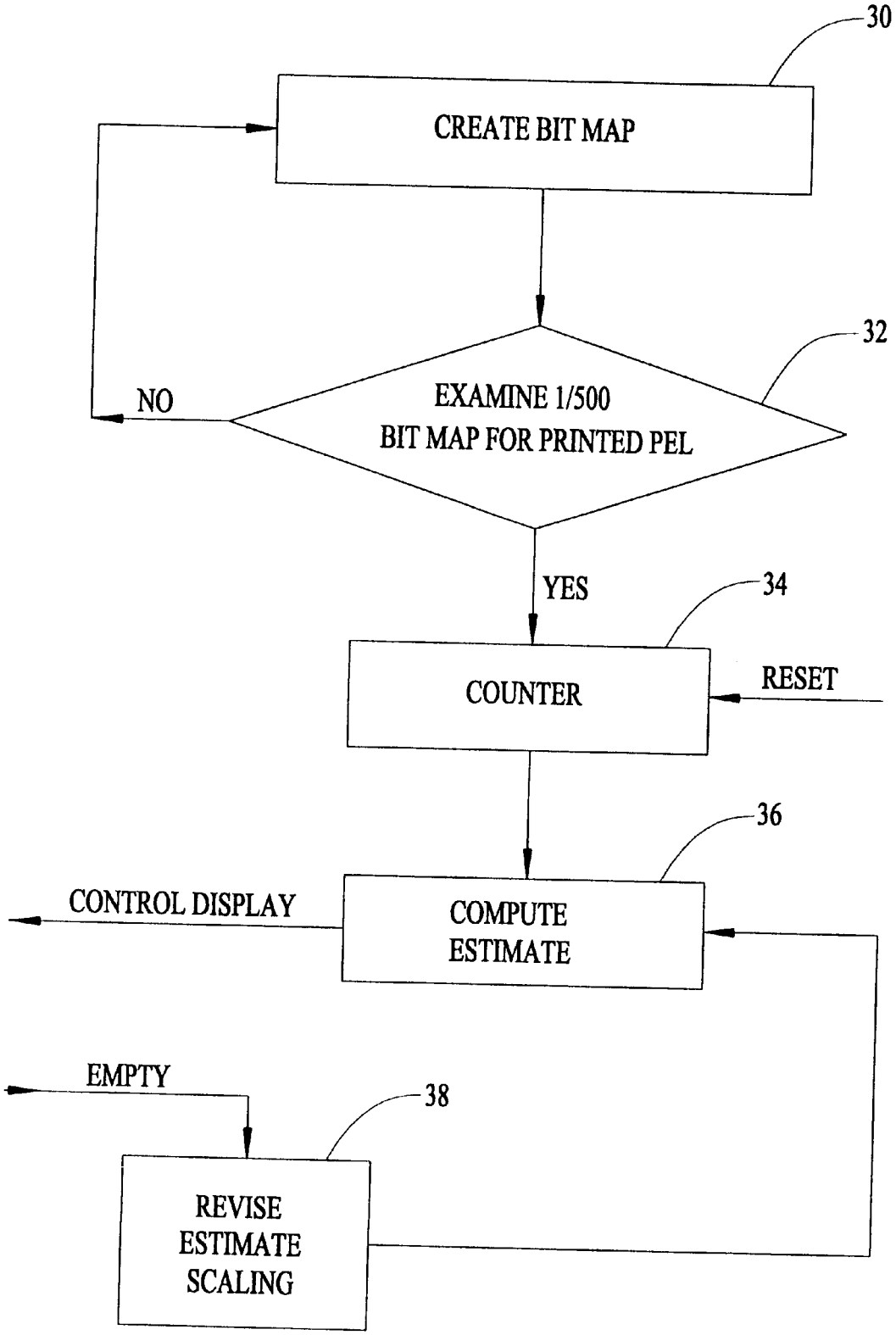
FIG. 2 illustrates the sequence of operations implementing this invention.

With reference to FIG. 2, the following sequence conducted by microprocessor 17 using memory 19 unless otherwise stated is employed. In the first function 30 a bit map of the image to be printed is created from information received on cable 3. In action 32, a section of the bit map of a size about 1/500 of an 8½ inch by 11 inch page (specifically, a rectangle in the bit map of 512×128 pels) are examined for at least one pel of toner. If yes, counter 34 is incremented. At each tenth page or other suitable interval, the estimate of remaining toner is computed, action 36.

The computation is an entirely linear one. Each increment of counter 34 results in an increase by a set amount of the former amount computed in action 36. The resulting amounts are subtracted from the initial amount in a full cartridge 20*a*–20*d*, which is, of course, readily known from the physical dimensions of the cartridges 20*a*–20*d*. The output of the estimate is employed to control display 21. In the four color embodiment, the computation as described is separate for each color and display 21 shows the four different results. The original or default amounts applied in the estimates are typically twice as large for color as for black, as black is typically text and lines.

When the empty signal is received for one of the cartridges 20*a*–20*d*, this activates the revise scaling function 38 for that cartridge. Since the computation is linear, the coefficient of the estimate computation is simply multiplied by the reciprocal of the proportion of usage computed at near empty. For example, if the estimate from the computation of 36 is ¾ empty, the coefficient of the estimate function is multiplied by 4/3, which scales that function to one based on the actual operation of the cartridge 20*a*–20*d* just used. In implementation, the number of counts to empty becomes the beginning number in the subsequent estimate, so that for example, half of the new number is interpreted as half empty. A new cartridge 20*a*–20*d* is inserted to replace the empty one and counter 34 is reset with respect to the replaced cartridges.

Since this embodiment was developed for use with an existing printer mechanism, the manner of sensing near empty on that particular mechanism is not known in detail. It apparently employs a stirrer which in a manner useful only when each of the cartridges 20*a*–20*d* are near empty.

It will be apparent that the dynamic estimates of this invention are applicable to all imaging devices whether employing dry material or liquid ink so long as the marking material is resupplied in a known volume, which is true for toner and ink in replaceable cartridges as is now very common.

We claim:

1. Imaging apparatus which applies marking material from a supply compartment to pel locations defined by a bit map stored electronically, said imaging apparatus having an electronic data processing apparatus which computes an estimate of remaining marking material as an amount which decreases by a predetermined amount with at least one pel printed with marking material in a predetermined area of said bit map, a sensor which senses the amount of marking material in said supply compartment, electronic data processing apparatus responsive to said sensing of said amount of marking material in said supply compartment to revise said predetermined amount used to compute said estimate, said revised amount being an amount such that the computation would have estimated said sensed amount.

2. The imaging apparatus as in claim 1 in which said sensor senses empty or near empty.

3. The imaging apparatus as in claim 2 in which said compartment is in a replaceable cartridge.

4. The imaging apparatus as in claim 3 in which said estimate amount is decreased when one pel in an area of about 512×128 pels at 600×600 dpi resolution is to be printed with marking material.

5. The imaging apparatus as in claim 2 in which said estimate amount is decreased when one pel in an area of about 512×128 pels at 600×600 dpi resolution is to be printed with marking material.

6. The imaging apparatus as in claim 1 in which said estimate amount is decreased when one pel in an area of about 512×128 pels at 600×600 dpi resolution is to be printed with marking materials.

* * * * *